US005586375A

United States Patent [19]

Cooperman et al.

[11] Patent Number: 5,586,375

[45] Date of Patent: Dec. 24, 1996

[54] TWO-PIECE SHOWER CURTAIN HOOK

[75] Inventors: Barbara Cooperman, New York, N.Y.; Robert M. Huff, Clark, N.J.

[73] Assignee: Springs Industries, Inc., Fort Mill, S.C.

[21] Appl. No.: 316,189

[22] Filed: Sep. 30, 1994

[51] Int. Cl.[6] ..... A44B 17/00

[52] U.S. Cl. ..... 24/716; 16/87.2; 24/378.1; 160/330

[58] Field of Search ..... 24/716, 265 H, 24/378.1, 113 MP, 103 K; 160/124, 126, DIG. 6, 330; D8/367, 373; 16/87.2, 95 D, 96 D; 63/29.1; 116/234–239

[56] References Cited

U.S. PATENT DOCUMENTS

| | | | |
|---|---|---|---|
| D. 344,670 | 3/1994 | Kearns | D8/367 |
| 345,904 | 7/1886 | Kenney | 24/378.1 |
| 1,811,619 | 6/1931 | Dwyer | 24/716 X |
| 1,986,517 | 1/1935 | Mitcheson | 16/87.2 |
| 2,320,003 | 5/1943 | Madan | 24/716 X |
| 2,805,457 | 9/1957 | Vaca | 24/378.1 |
| 3,161,929 | 12/1964 | Swett | 16/87.2 X |
| 3,596,306 | 8/1971 | Wachenheimer | 24/716 X |
| 5,339,884 | 8/1993 | Angerman | 160/330 |

FOREIGN PATENT DOCUMENTS

| | | | |
|---|---|---|---|
| 42164 | 11/1965 | German Dem. Rep. | 16/87.2 |

*Primary Examiner*—Peter M. Cuomo
*Assistant Examiner*—Robert J. Sandy
*Attorney, Agent, or Firm*—Stroock & Stroock & Lavan

[57] ABSTRACT

A shower curtain hook including a hook including a body for permitting the shower curtain hook to hang from a shower curtain rod, a tail for permitting the shower curtain to rest thereon, a positioning plate supported on the tail, and a decorative cover having a mounting bracket adapted to receive the positioning plate so that the decorative cover may be releasably secured to the positioning plate.

7 Claims, 2 Drawing Sheets

TWO-PIECE SHOWER CURTAIN HOOK

BACKGROUND OF THE INVENTION

The present invention relates generally to a two-piece shower curtain hook for hanging a shower curtain and, in particular, to a novel shower curtain hook construction which permits decorative covers to be releasably secured on each hook.

Generally, shower curtains are hung on a curtain rod by using shower curtain rings or shower curtain hooks. Shower curtain rings are often favored because they secure the shower curtains with the rings and prevent the curtain from falling off the ring and rod. However, a disadvantage of shower curtain rings is that they are difficult to engage and disengage from the shower curtain and the curtain rod.

Heretofore, shower curtain hooks have been primarily comprised of a one-piece construction made from hard plastic, such as polypropylene or nylon, and have a large curved body portion to permit the hook to rest on a shower curtain rod and includes an integral finger on which a shower curtain is placed. The construction of such one-piece shower curtain hooks are less than completely satisfactory because the shower curtain can slip off the finger portion. In addition, one-piece shower curtain hooks offer limited design alternatives.

Accordingly, an improved shower curtain hook having a two-piece construction which securely holds a shower curtain and provides unlimited decorative alternatives is desired.

SUMMARY OF THE INVENTION

Generally speaking, in accordance with the present invention, a two-piece shower curtain hook comprising a hook and a cover is provided. The shower curtain hook includes a body for permitting the shower curtain hook to hang from a shower curtain rod, a tail on which the shower curtain rests and a positioning plate supported by the tail for retaining the shower curtain on the tail. A cover includes a retaining mechanism adapted to receive the positioning plate therein and provide a decorative cover that is releasably securable and removable from the hook.

Accordingly, an object of the present invention is to provide a two-piece shower curtain hook construction that securely retains a shower curtain.

Another object of the present invention is to provide a two-piece shower curtain hook construction that permits the use of interchangeable decorative covers.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Reference is made to FIGS. 1–4 wherein a two-piece shower curtain hook assembly, generally indicated at 10, is depicted. Shower curtain assembly 10 includes a shower hook, generally indicated as 11, and a cover, generally indicated at 30, which is adapted to be releasably secured to shower hook 11 and to provide a decorative shower curtain hook construction.

Figure 1:
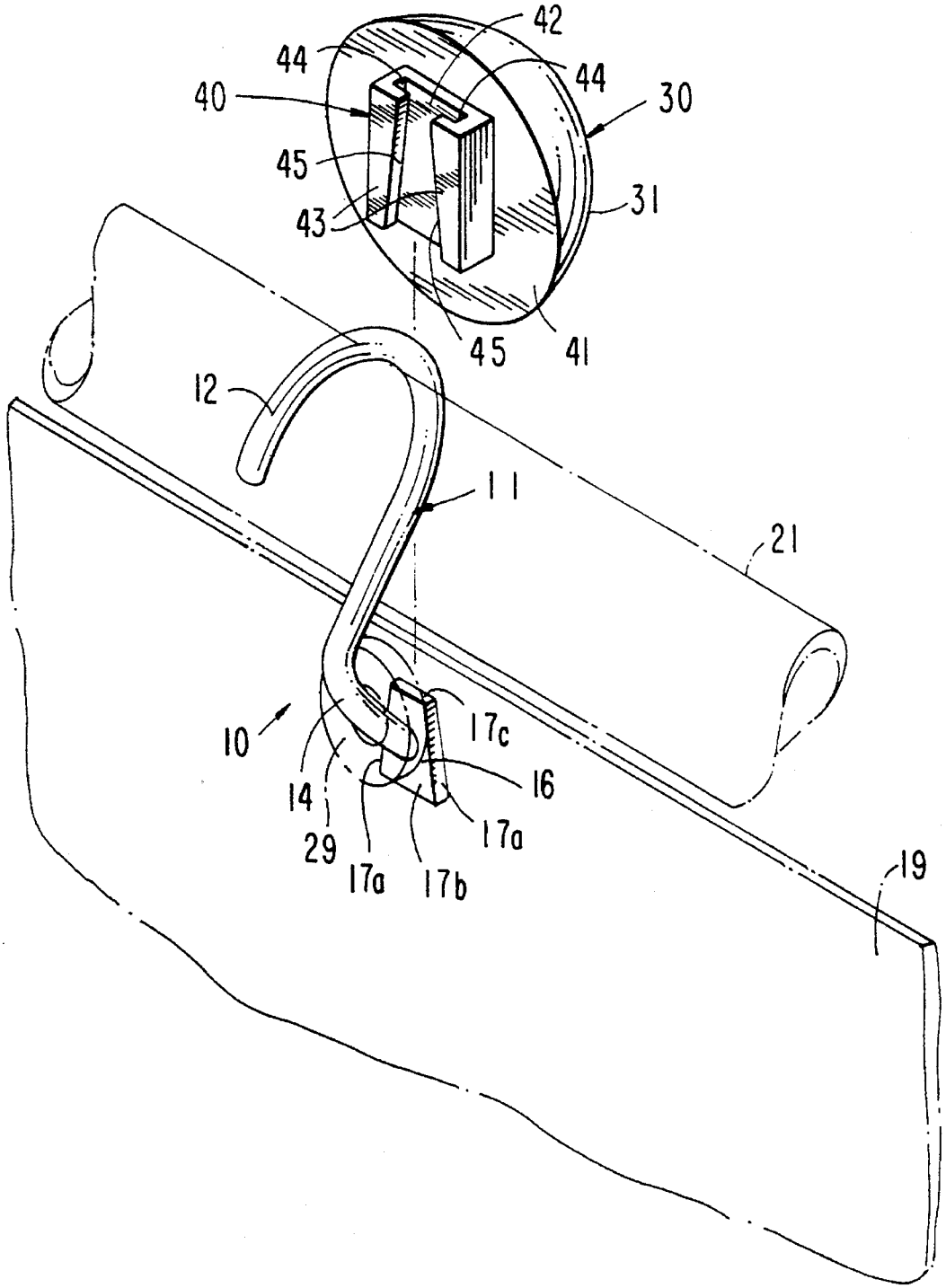
FIG. 1 is a perspective view of a shower curtain hook and accompanying ornamental member in accordance with the present invention.
Figure 3:
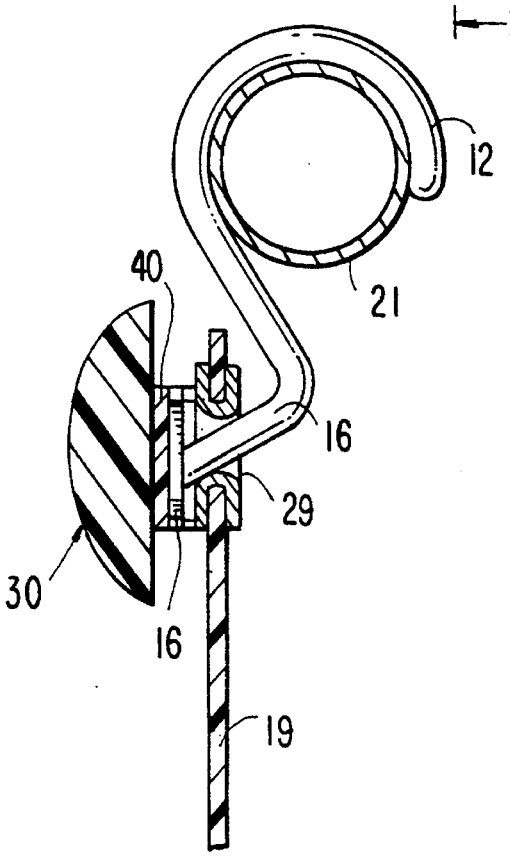
FIG. 3 is a sectional view taken along line 3—3 of FIG. 2.
Figure 4:
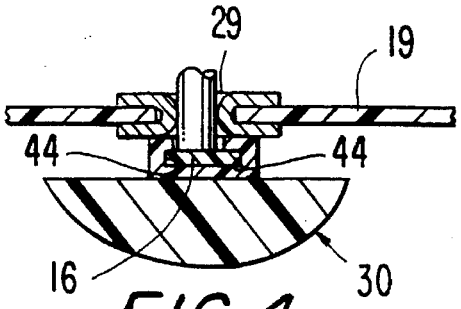
FIG. 4 is a sectional view taken along line 4—4 of FIG. 2.

As is more particularly illustrated in FIGS. 1 and 3, hook 11 is similar in profile to a conventional shower hook and includes a large curved body 12 for supporting the hook on a shower curtain rod 21 and a depending tail 14 that is insertable into an opening 29 in a shower curtain 19.

A positioning plate 16 is supported at the end of tail 14 and is integrally formed with tail 14 so that a shower curtain will be prevented from sliding off tail 14. In an exemplary embodiment of the instant invention, positioning plate 16 is of uniform thickness and is in the shape of an isosceles trapezoid defined by opposed inclined side surfaces 17*a*, a flat top surface 17*b* and a bottom surface 17*c*. Although the positioning plate 16 can be formed of other shapes such as a rectangle, semi-circle or triangle, the isosceles trapezoidal shape has been found to provide certain functional benefits which will be described below.

Cover 30 includes a decorative front surface 31 and a mounting bracket 40 disposed on rear surface 41 of cover 30. Mounting bracket 40 includes a back wall 42 (which can be the rear surface of cover 30 when cover 30 and mounting bracket 40 are formed in a one-piece construction) and two opposed symmetrical retaining shoulders 43. Mounting bracket 40 includes undercut slots 44 that space the inside wall of retaining shoulders 43 away from back wall 42 by a distance that is slightly larger than the uniform thickness of positioning plate 16. Also, in the exemplary embodiment depicted in FIGS. 1–4, retaining shoulders 43 include side walls 45 facing each other. Undercut slots 44 can also be inclined in order to conform to the opposed inclined surfaces 17*a* of positioning plate 16.

Although the shape of undercut slots 44 and opposed side walls 45 are not required to be inclined, by conforming at least undercut slot 44 to the configuration of the opposed inclined surfaces 17*a* of positioning plate 16, the insertion, retention and stabilization of positioning plate 16 into mounting bracket 40 is obtained.

Figure 2:
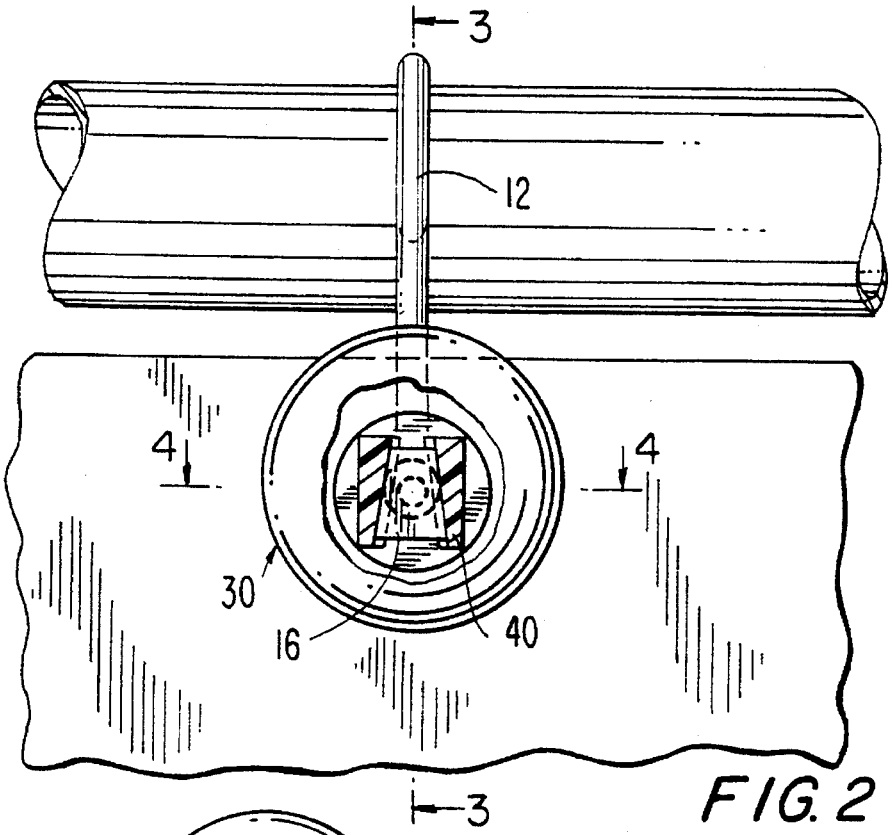
FIG. 2 is a front elevational view of the shower curtain hook of FIG. 1 with the ornamental design mounted thereon.

With specific reference to the dashed lines in FIG. 1, cover 30 is secured to positioning plate 16 by inserting positioning plate 16 into undercut slots 44 formed in mounting bracket 40. By reason of the shape of inclined surface 17*a* and the incline of undercut slots 44, cover 30 will fit over positioning plate 16 and will be supported thereby. Furthermore, because of the incline of surfaces 17*a*, cover 30 will be prevented from wobbling or moving around because of the weight of cover 30 as cover 30 sits on positioning plate 16. As depicted in FIGS. 2 and 3, when cover 30 is positioned on positioning plate 16, shower curtain 19 is prevented from falling off tail 14 of shower curtain hook 10. However, if it is desired to remove shower curtain 19, cover 30 can be slid off positioning plate 16 to facilitate removal of shower curtain 19 from positioning plate 16. In addition, shower curtain 19 can be removed by sliding shower curtain 19 around and over hook portion 12. Similarly, shower curtain 19 can be placed on tail 16 by placing hook portion 12 through eyelet 29 until shower curtain 19 rests on tail 16. Also, the front of cover 30 can be fabricated in different colors, shapes and designs (flowers, religious symbols, animals, etc.) and offers the user the opportunity to change the covers whenever a decorative change is desired. Moreover, it is contemplated that the angle of positioning plate 16 or tail 14 relative to hook portion 12 will be such that cover 30 will angle downward so that an individual's line of vision sees the entire surface of cover 30 even though cover 30 is mounted above one's line of sight.

Likewise, it is contemplated that other types of mounting brackets and positioning plates may be used while still remaining within the scope of the present invention. For example, a twist lock mechanism may be used whereby the mounting bracket is twisted and locks onto the positioning plate. Another example is to construct the mounting bracket to include a hinge mechanism to further secure the decorative cover onto the positioning plate. As a third example, the positioning plate may have a threaded screw emanating therefrom so as to receive a compatible female thread in the mounting bracket.

In an exemplary embodiment, in order to be compatible with the eyelet size of most commercially available shower curtains, the diameter of hook portion 12 and tail 14 may vary, keeping in mind that the thickness of tail 14 must be sufficiently narrow to receive a shower curtain thereon. Furthermore, shower hook 11 and cover 30 are preferably made of metal, zinc or may be injection molded using nylon or polypropylene.

It will thus be seen that the objects set forth above, among those made apparent from the preceding description, are efficiently attained and, since certain changes may be made in the above constructions without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A shower curtain hook, including:

a hook including a body for permitting the shower curtain hook to hang from a shower curtain rod, a tail for supporting a shower curtain thereon, and a positioning plate supported on said tail, said tail being constructed to support a shower curtain positionable intermediate said positioning plate and said hook; and a decorative cover having a mounting means, said mounting means being adapted to receive said positioning plate so that said decorative cover may be releasably secured to said positioning plate.

2. The shower curtain hook as claimed in claim 1, wherein said positioning plate and mounting means are configured so that said decorative cover will not wobble when it rests on said positioning plate.

3. The shower curtain hook as claimed in claim 1, wherein said positioning plate includes inclined surfaces and whereby said mounting means on said cover plate includes slots that are inclined at an angle substantially similar to the incline of the positioning plate for permitting said mounting means to be seated on said plate.

4. The shower curtain hook as claimed in claim 1, wherein said cover includes a front surface capable of having a plurality of decorative shapes, and said mounting means is disposed on an opposed surface of said cover.

5. A shower curtain hook adapted to receive a decorative cover, including:

a body for permitting a shower curtain hook to hang from a shower curtain rod, said body including a tail for supporting a shower curtain thereon, and a positioning plate connected to said tail, said tail being constructed to support a shower curtain positionable on said tail and between said hook and said positioning plate, said positioning plate being adapted to receive a decorative cover.

6. The shower curtain hook as claimed in claim 5, wherein said positioning plate is in the shape of an isosceles trapezoid.

7. The shower curtain hook as claimed in claim 5, wherein said positioning plate is tapered so that a decorative cover will be securably placed thereon.

* * * * *